United States Patent [19]

Graef et al.

[11] 4,355,797

[45] Oct. 26, 1982

[54] PICKER MECHANISM FOR AUTOMATIC BANKING MACHINES

[75] Inventors: Harry T. Graef, Dover; Scott A. Mercer, Hanoverton; Jeffrey A. Hill; Kevin H. Newton, both of North Canton, all of Ohio

[73] Assignee: Diebold Incorporated, Canton, Ohio

[21] Appl. No.: 194,338

[22] Filed: Oct. 6, 1980

[51] Int. Cl.[3] ..... B65H 3/08

[52] U.S. Cl. ..... 271/20; 271/30 A; 271/104; 271/107

[58] Field of Search ..... 271/20, 30 A, 107, 104, 271/19, 24, 25, 108, 96; 221/211

[56] References Cited

U.S. PATENT DOCUMENTS

| | | | |
|---|---|---|---|
| 614,772 | 11/1898 | Siegel | 271/104 UX |
| 758,453 | 4/1904 | Lagerman | 271/108 |
| 2,524,417 | 10/1950 | Bamber | 271/20 |
| 2,912,240 | 11/1959 | Frankle et al. | 271/20 |
| 3,578,312 | 5/1971 | Kocourek | 271/20 |
| 4,113,140 | 9/1978 | Graef et al. | 221/6 |
| 4,154,437 | 5/1979 | Butchek et al. | 271/6 |

FOREIGN PATENT DOCUMENTS

| | | | |
|---|---|---|---|
| 52-25370 | 2/1977 | Japan | 271/20 |
| 1525698 | 9/1978 | United Kingdom . | |

*Primary Examiner*—Bruce H. Stoner, Jr.
*Attorney, Agent, or Firm*—Frease & Bishop

[57] ABSTRACT

Picker mechanism for picking notes from a note supply stack in a note dispenser of an automatic banking or teller machine (ATM) which withdraws notes from the supply stack through an access opening in a note supply container laterally of the opening. The access opening has one dimension smaller than the length of the note being laterally withdrawn. The picker mechanism engages the note being withdrawn with a picker cup by combined frictional pressure and suction. The picker cup during note withdrawal moves in multi-directions toward and away from the note stack through the access opening as well as back and forth in directions generally parallel to the length of the note being withdrawn.

5 Claims, 22 Drawing Figures

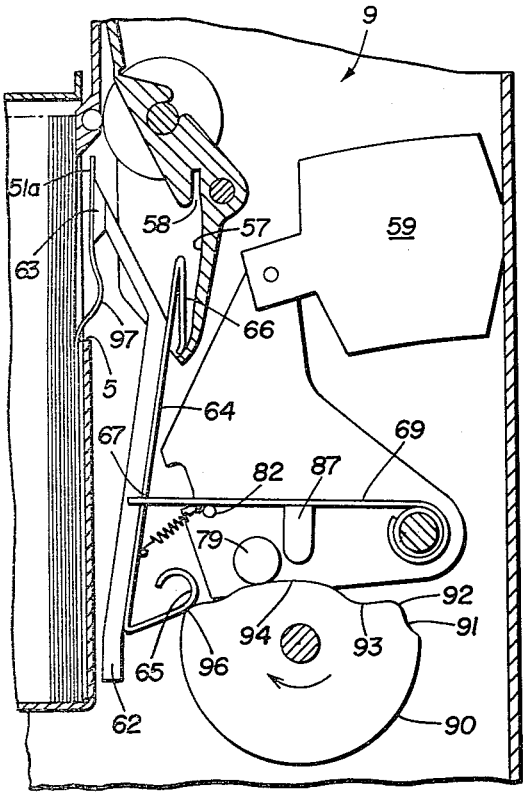
FIG. 19
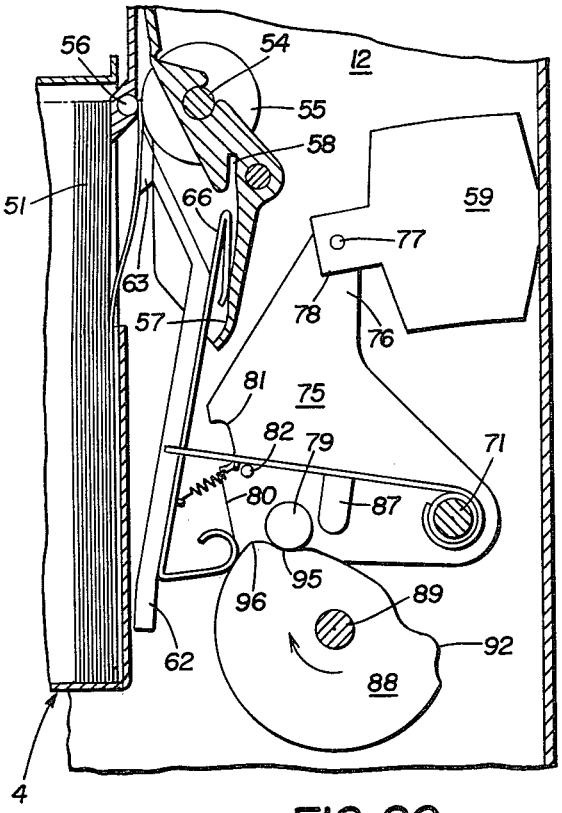
FIG. 20
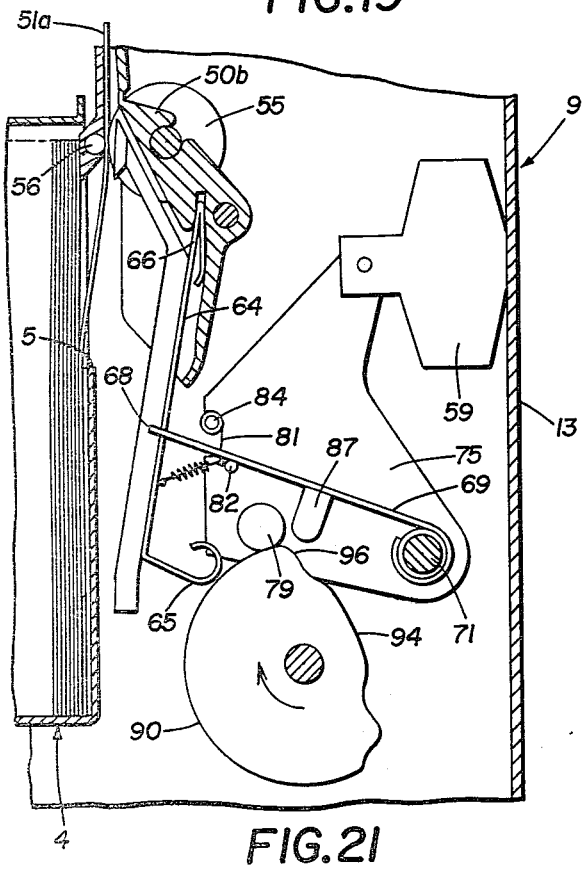
FIG. 21
FIG. 14
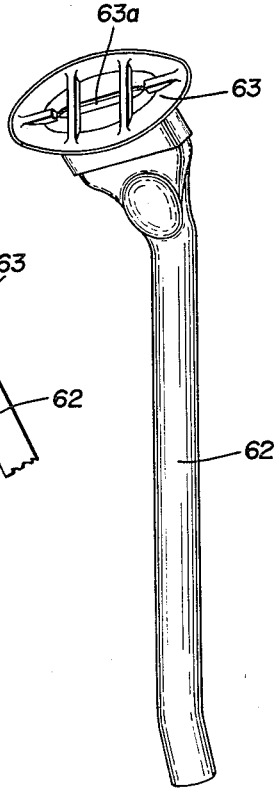
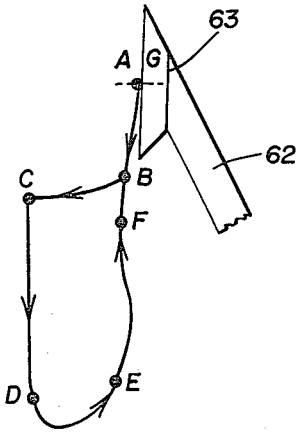
FIG. 13

PICKER MECHANISM FOR AUTOMATIC BANKING MACHINES

CROSS-REFERENCE TO RELATED PATENTS

The improved picker mechanism may be used with the devices disclosed in U.S. Graef et al. Pat. No. 4,113,140, dated Sept. 12, 1978, U.S. Butcheck et al. Pat. No. 4,154,437, dated May 15, 1979, and copending application of Graef et al. Ser. No. 193,847, filed Oct. 3, 1980.

BACKGROUND OF THE INVENTION

1. Field of the Invention

The invention relates to automatic banking or teller machines (ATM's) and particularly to ATM's which may be installed at free-standing locations either remote from central banks or at locations accessible to customers in or adjacent central banks for dispensing paper money notes of one or more denominations.

Further, the invention relates to an ATM in which each denomination of paper money note to be dispensed is supplied to the ATM in its own sealed, tamper-indicating note container of the general type shown in U.S. Pat. No. 4,113,140.

More particularly, the invention relates to a picker mechanism which picks notes one at a time from a sealed, tamper-indicating note container of the type shown in said U.S. Pat. No. 4,113,140 through a container access opening when uncovered, which access opening has dimensions one of which is materially less than the length of the paper money note being picked.

Further, the invention relates to a picker mechanism which finally moves such notes through such access opening in a direction extending generally longitudinally of the length of the note from a stack of notes in the note container laterally of the stack to feed the note to a transparent mechanism which dispenses the note to a customer operating the ATM.

In addition, the invention relates to a picker mechanism which utilizes a picker head which contacts a note through the note container access opening supplied with suction generated in a bellows forming part of the picker mechanism, combined with frictional pressure of the picker head on the note being picked during multi-directional movements of the picker head to withdraw each note from the note container.

Finally, the invention relates to equipping an ATM with a picker mechanism including a picker head having multi-directional movements during picking of a note from a note container, which movements include movement toward and away from one end portion of the note in a stack of notes contained in a note container through the container access opening, as well as movement longitudinally in each direction with respect to the length of the note generally at right angles to said movement toward and away from the note, thereby permitting the formation of a loop in a note to enable the leading end of the note to be fed to adjacent ATM transport mechanism which completes the withdrawal of each note from the note container.

2. Description of the Prior Art

Various types and kinds of picker mechanisms are known in the operation of ATM's for picking notes from a stack of notes and feeding the same to a dispensing transport mechanism, among others, picker mechanisms such as shown in U.S. Pat. Nos. 3,077,983 and 3,760,158.

However, applicants are unaware of any prior known picker mechanism which picks and withdraws paper money notes from a security note container through a rectangular container access opening smaller in at least one direction than the dimensions of the note being picked, or which utilizes a picker head supplied with self-generated vacuum and which has frictional engagement with notes being picked which combined frictional engagement and suction during contact with a note moves the note in both directions extending longitudinally of the note as well as in a direction normal to the longitudinal extent of the note.

Thus, a need has existed in the banking field for a new type of picker mechanism which can withdraw paper money notes under conditions of high security from sealed, tamper-indicating note containers which supplies ATM's with money to be dispensed.

SUMMARY OF THE INVENTION

Objectives of the invention include providing an ATM with a new type of picker mechanism having a picker head movable in multiple directions during the operation of picking a note from a note container through an opening smaller in at least one direction than the dimensions of the note being picked; providing such picker mechanism with a picker head having dual operating characteristics in carrying out a picking operation by combined picker-generated suction and frictional note engagement during multi-directional movement of the picker head; providing such picker head with a connected bellows which is actuated during picker head movement to establish a condition of suction at the head thereby eliminating the need for an outside source of suction; and providing a new picker mechanism and mode of operation which achieve the stated objectives in a reliable, effective, easily serviced manner and which solve a problem and satisfies a need that has emerged in the field of construction and use of ATM's.

These and other objectives and advantages may be obtained by the construction stated in general terms as mechanism for picking notes one at a time from a supply stack of notes located in a sealed, tamper-indicating note container housed in an ATM through a container access opening when uncovered, in which the access opening has a dimension in at least one direction less than the corresponding dimension of the notes being picked, and in which driven conveyor means for the notes being picked are located adjacent the access opening; including, a picker member having a picker cup, means mounting the picker member for moving the cup in directions into and out of the access opening combined with back-and-forth movement in directions along the direction of said less opening dimension and at right angles to said in-and-out movement directions to peel an end of a note exposed through said access opening from the supply stack along the opening and along the next note in the stack first in a direction away from the adjacent conveyor means to form a loop in said note end, then out of the opening away from the stack and toward and into engagement with said conveyor means; means for driving said picker member to move the cup and note end in said directions; and means pressing the cup against the note end engaged thereby while supplying suction to the cup during such engagement.

BRIEF DESCRIPTION OF THE DRAWINGS

A preferred embodiment of the invention—illustrative of the best mode in which applicants have contemplated applying the principles—is set forth in the following description and shown in the drawings and is particularly and distinctly pointed out and set forth in the appended claims.

FIG. 13 is a diagram illustrating the path of movement of a picker head from the beginning to the end of a note picking operation;

FIG. 14 is a perspective view of the improved picker head;

FIGS. 15, 16, 17, 18, 19, 20 and 21 are diagrammatic views showing the position of certain picker mechanism components at the various stages and locations of its operation indicated in the diagram of FIG. 13.

Similar numerals refer to similar parts throughout the various Figures of the drawings.

DESCRIPTION OF THE PREFERRED EMBODIMENT

Figure 2:
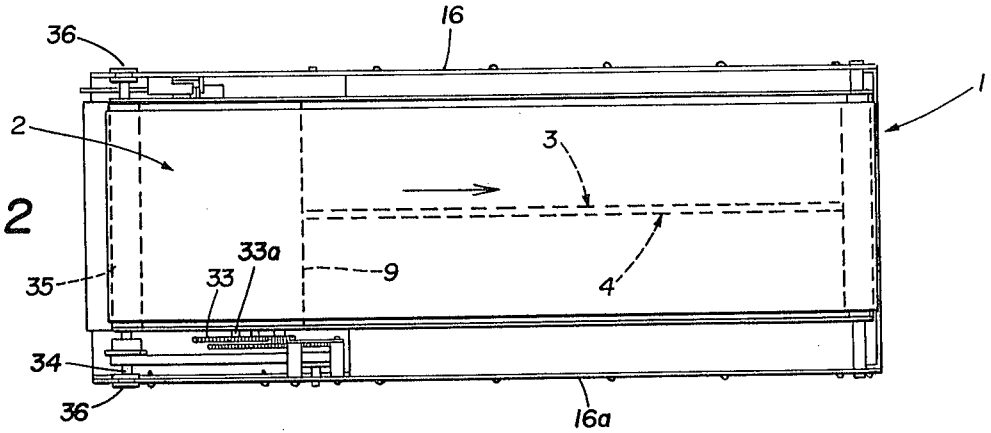
FIG. 2 is a diagrammatic top view of the unit shown in FIG. 1.
Figure 1:
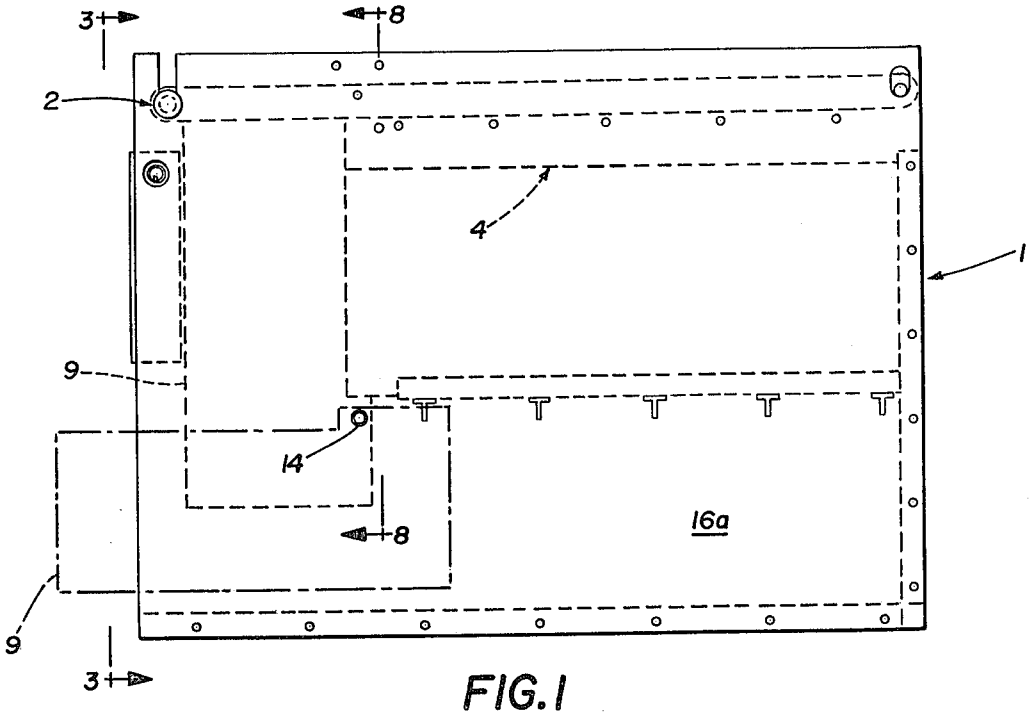
FIG. 1 is a somewhat diagrammatic side view of an ATM equipped with the improved picker mechanism.
Figure 3:
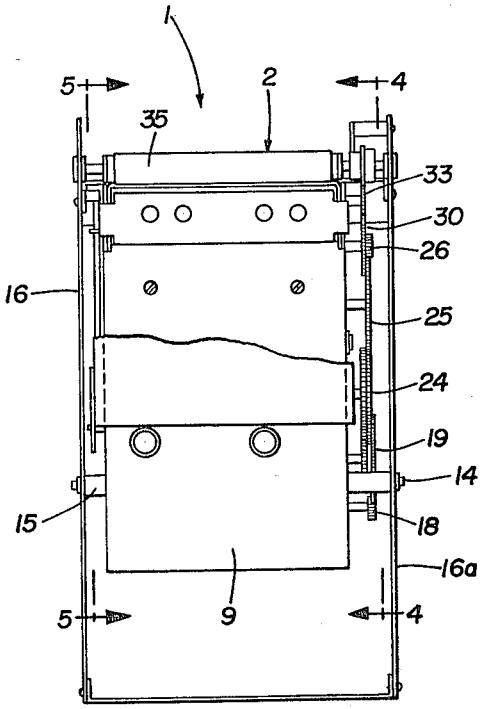
FIG. 3 is an end view looking in the direction of the arrows 3—3, FIG. 1 of the unit shown in FIG. 1.

A typical cash dispenser unit for an ATM is diagrammatically illustrated at 1 in FIGS. 1, 2 and 3 of the general type shown in U.S. Pat. No. 4,154,437 loaded with two sealed, tamper-indicating note containers generally of the type shown in U.S. Pat. No. 4,113,140. The unit 1 has the improved picker mechanism of the invention mounted therein for withdrawing notes from the note containers and delivering such notes to the transport mechanism of the unit 1. Details of the new picker mechanism and its construction and operation are shown in FIGS. 4 through 22.

The ATM in which the dispenser unit 1 is located may be energized when a customer enters a coded card into the ATM. The coded card is verified to confirm that it is an authorized card and that the user thereof is the authorized user, through card readers and other known devices contained in the ATM or electrically connected thereto.

After the card and customer verification steps have been carried out, keyboard entries may be made by the customer in accordance with instructions presented to the customer including, among others, the amount of currency that the customer desires to withdraw.

The currency dispensed may be delivered from the dispenser unit 1 by the transport mechanism or conveyor generally indicated at 2 in a manner shown and described in said U.S. Pat. No. 4,154,437.

The notes dispensed are contained in a sealed, tamper-indicating container, two of which, preferably containing different denomination notes, are generally indicated at 3 and 4 in FIG. 1, a part of the note container 4 being shown in FIGS. 9, 10, 11 and 15 through 21.

Figure 9:
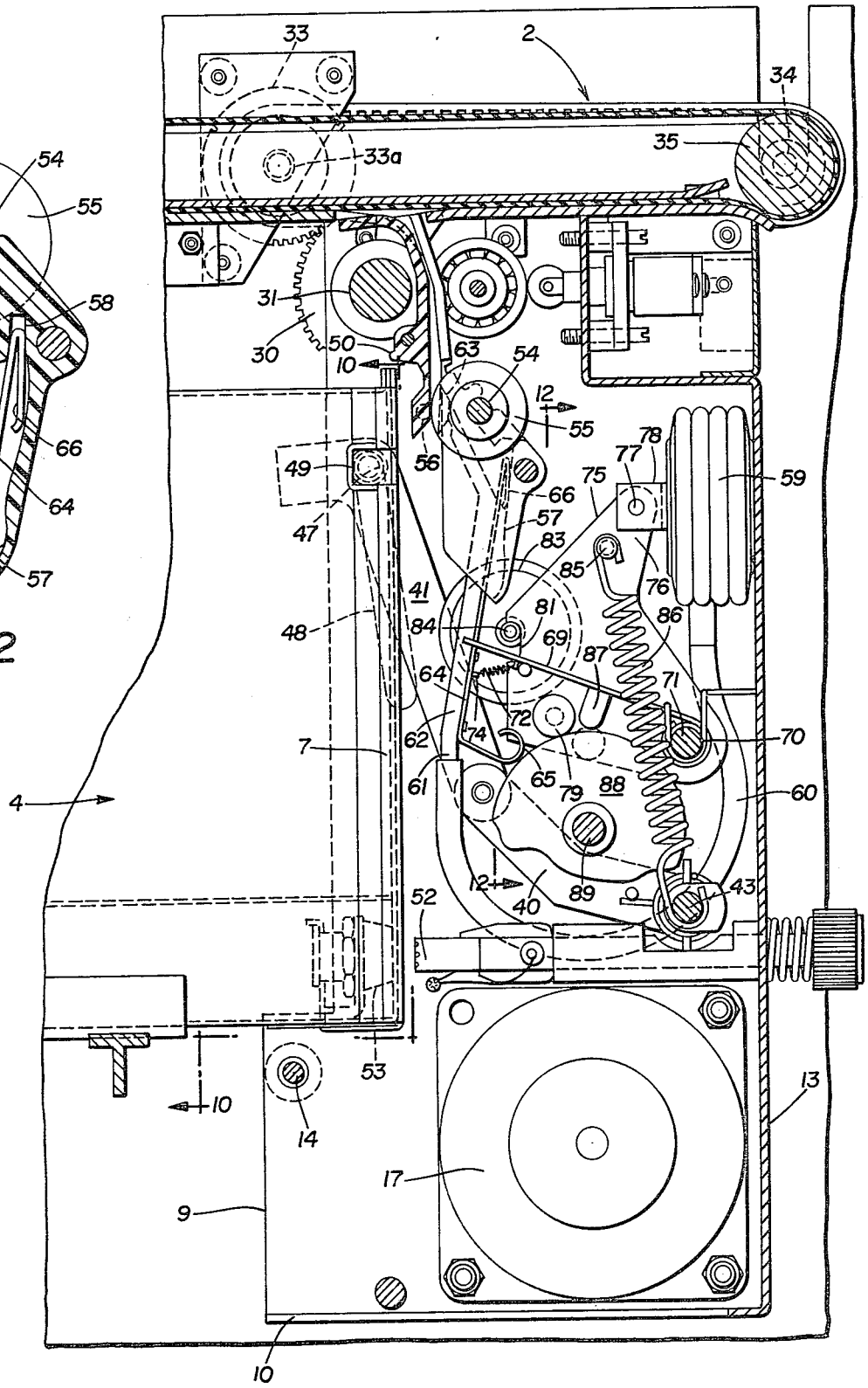
FIG. 9 is a sectional view taken on the line 9—9, FIG. 8.
Figure 12:
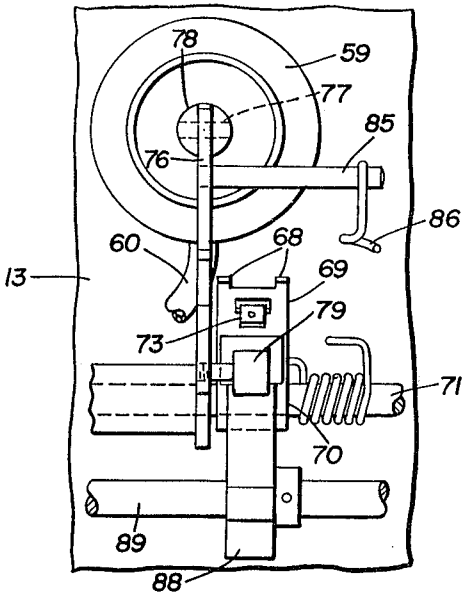
FIG. 12 is a fragmentary view looking in the direction of the arrows 12—12, FIG. 9.
Figure 11:
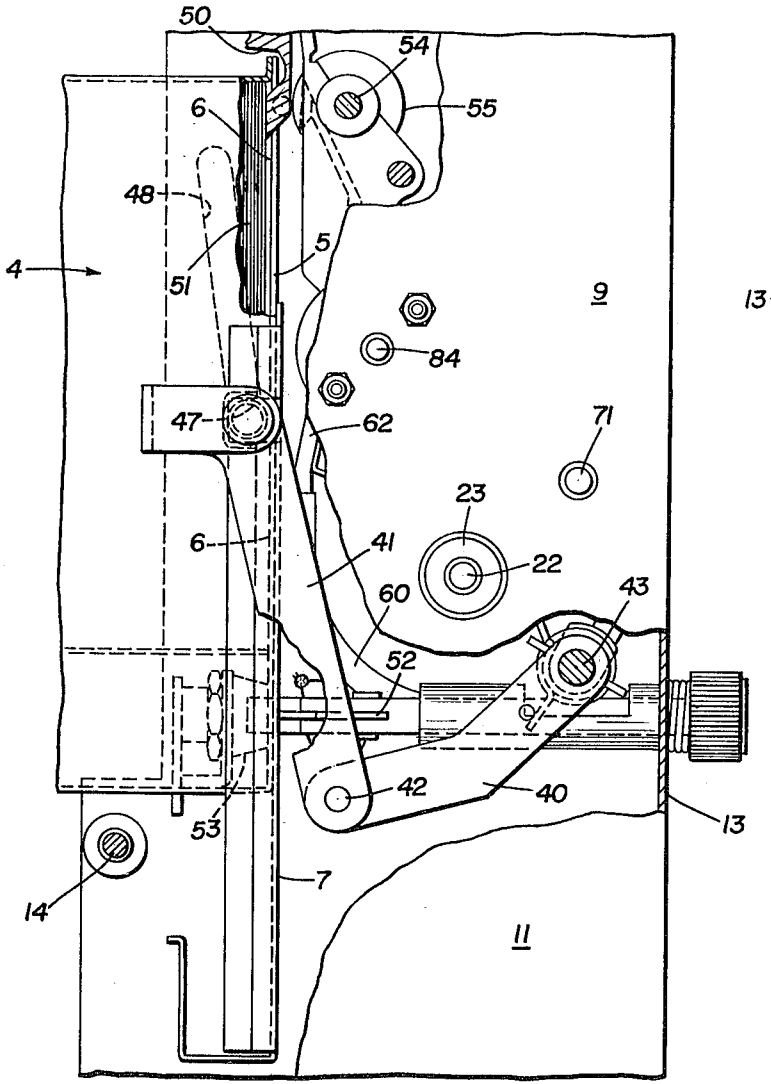
FIG. 11 is a view similar to FIG. 9 with parts broken away and showing the door to the note container in open position.
Figure 10:
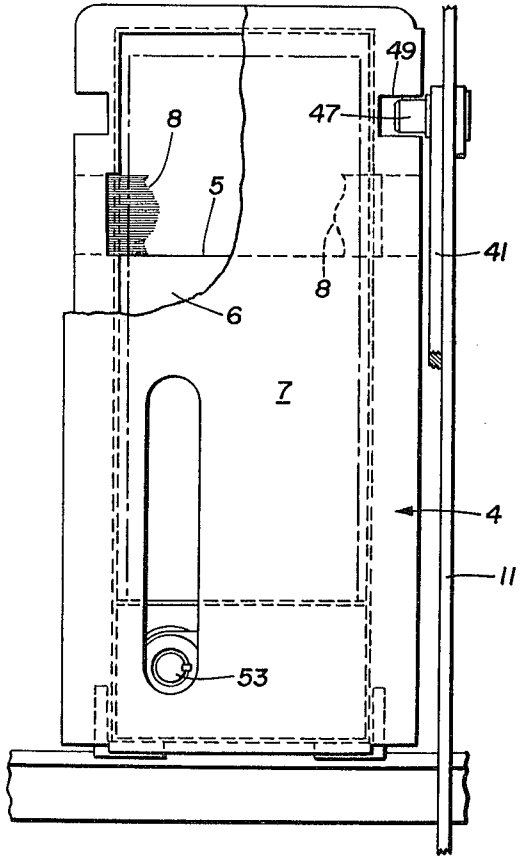
FIG. 10 is an end elevation with parts broken away and in section of one of the note containers installed in the unit looking in the direction of the arrows 10—10, FIG. 9.

Each note container 3 and 4 has an access opening 5 formed in an end wall 6 thereof which is closed by a sliding door 7, the sliding door 7 being shown in closed and locked position in FIGS. 9 and 10 and in open position in FIG. 11. Details of the construction and operation of the note containers 3 and 4 are shown in said U.S. Pat. Nos. 4,113,140 4,154,437 and application Ser. No. 193,847 filed Oct. 3, 1980.

Each note container has a pair of spaced brushes with bristles indicated at 8 projecting across parts of the access opening 5 as shown in FIG. 10, the purpose of which will be described below.

The new and improved picker mechanism of the invention includes components mounted in a picker housing 9 having side walls 11 and 12 and a closure wall 13 and the lower ends of walls 11, 12 and 13 terminate in an in-turned flange 10. The housing 9 is pivotally mounted on a pivot shaft 14 the ends of the shaft being mounted at 15 and **15*a* on spaced frame members 16 and 16*a* of the dispenser unit 1**.

A drive motor 17 is mounted on the picker housing 9 having a pinion 18 on its drive shaft meshing with a gear 19 whose connected double gear 20 meshes with the gear 21 mounted on a cam shaft 22 journaled at 23 on the picker housing sidewalls 11 and 12. The gear 21 forms part of a double gear 24 meshing with a idler gear 25 which drives pinion 26 mounted on a shaft 27 also journaled on the housing sidewalls 10 and 11 at 28. Pinion 26 forms part of a double gear 29 which meshes with the gear 30 mounted on a shaft 31 also journaled at 32 on the housing sidewalls 11 and 12.

When the picker housing is in closed position shown in the drawings, gear 30 meshes with gear 33 on a shaft **33*a* spaced from drive shaft 34 for one of the rolls 35 of the conveyor 2. The conveyor drive shaft 34 is journaled at its ends on the frame members 16 and 16*a* at 36**.

Figure 6:
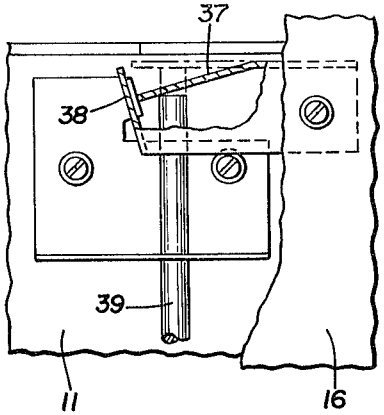
FIG. 6 is an enlarged fragmentary view of certain of the parts shown in the top right-hand corner of FIG. 5 with the picker housing latch in latched mode.
Figure 7:
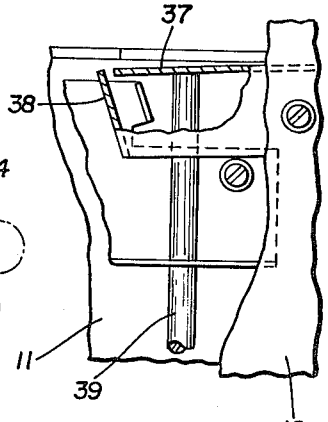
FIG. 7 is a view similar to FIG. 6 but showing the latch in unlatched mode.
Figure 5:
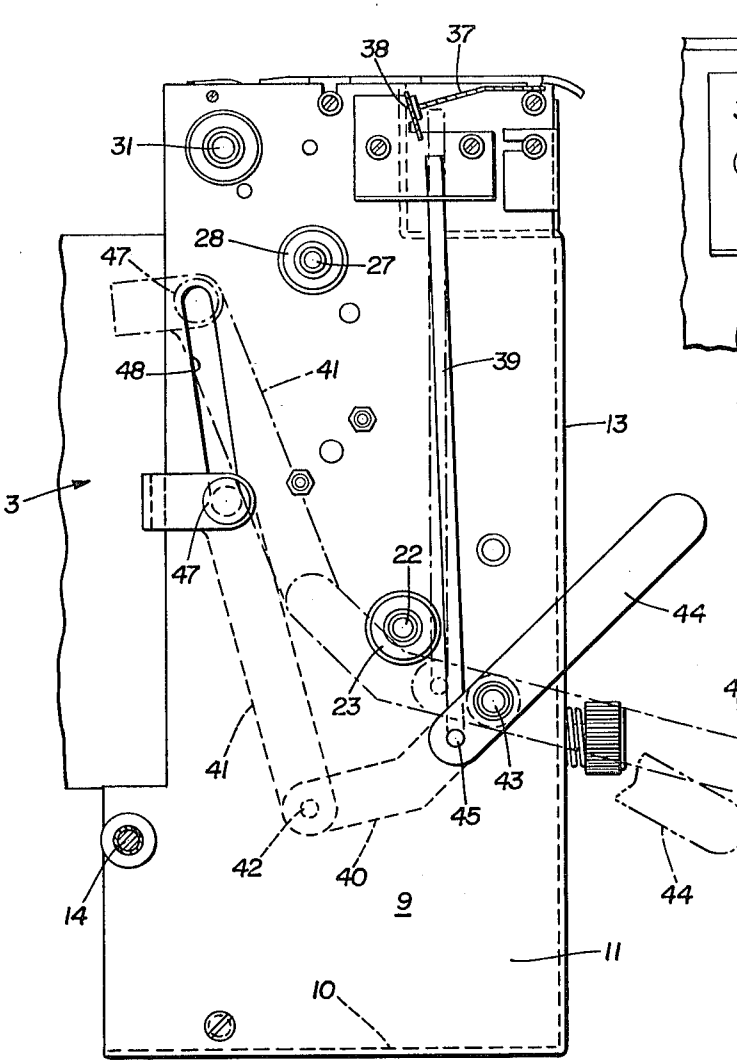
FIG. 5 is a sectional view similar to FIG. 4 looking in the other direction on the line 5—5, FIG. 3.
Figure 4:
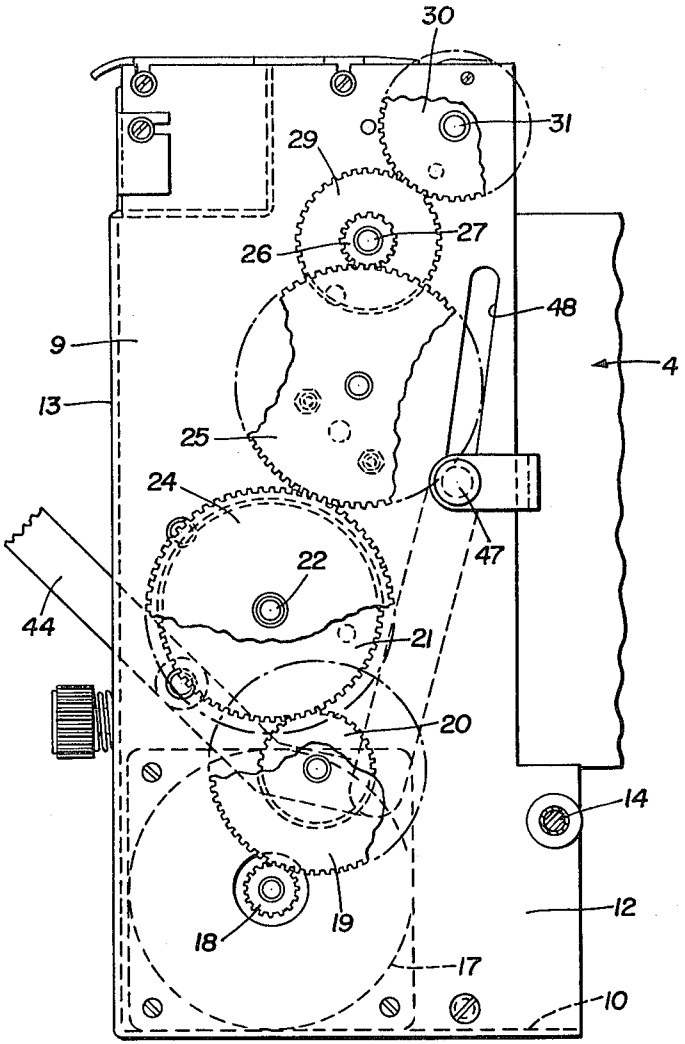
FIG. 4 is a sectional view taken on the line 4—4, FIG. 3.

The picker housing 9 normally is latched closed by a spring latch member 37 mounted on the frame member 16 engaged by clip 38 carried by the housing side wall 11 shown in latched position in FIG. 5, and in unlatched position in FIG. 6. when unlatched by a latch actuator 39 in a manner to be described.

When the picker housing 9 is unlatched, it may be moved to an open position shown in a dot-dash lines in FIG. 1, by pivotal movement about the pivot shaft 14. When the picker housing 9 is moved to open position, the gear 30 is separated from the gear 33. All of the other gearing in the gear train from pinion 18 to gear 30 described above being mounted on the picker housing 9 and moving with the picker housing when opened.

The picker housing shown may be similar to a closure housing shown in said application Ser. No. 193,847, filed Oct. 3, 1980, and the components of the closure housing in said application may be contained in the picker housing 9. Similarly, the picker mechanism shown herein may be contained in the closure housing of said application Ser. No. 193,847, filed Oct. 3, 1980.

Figure 8:
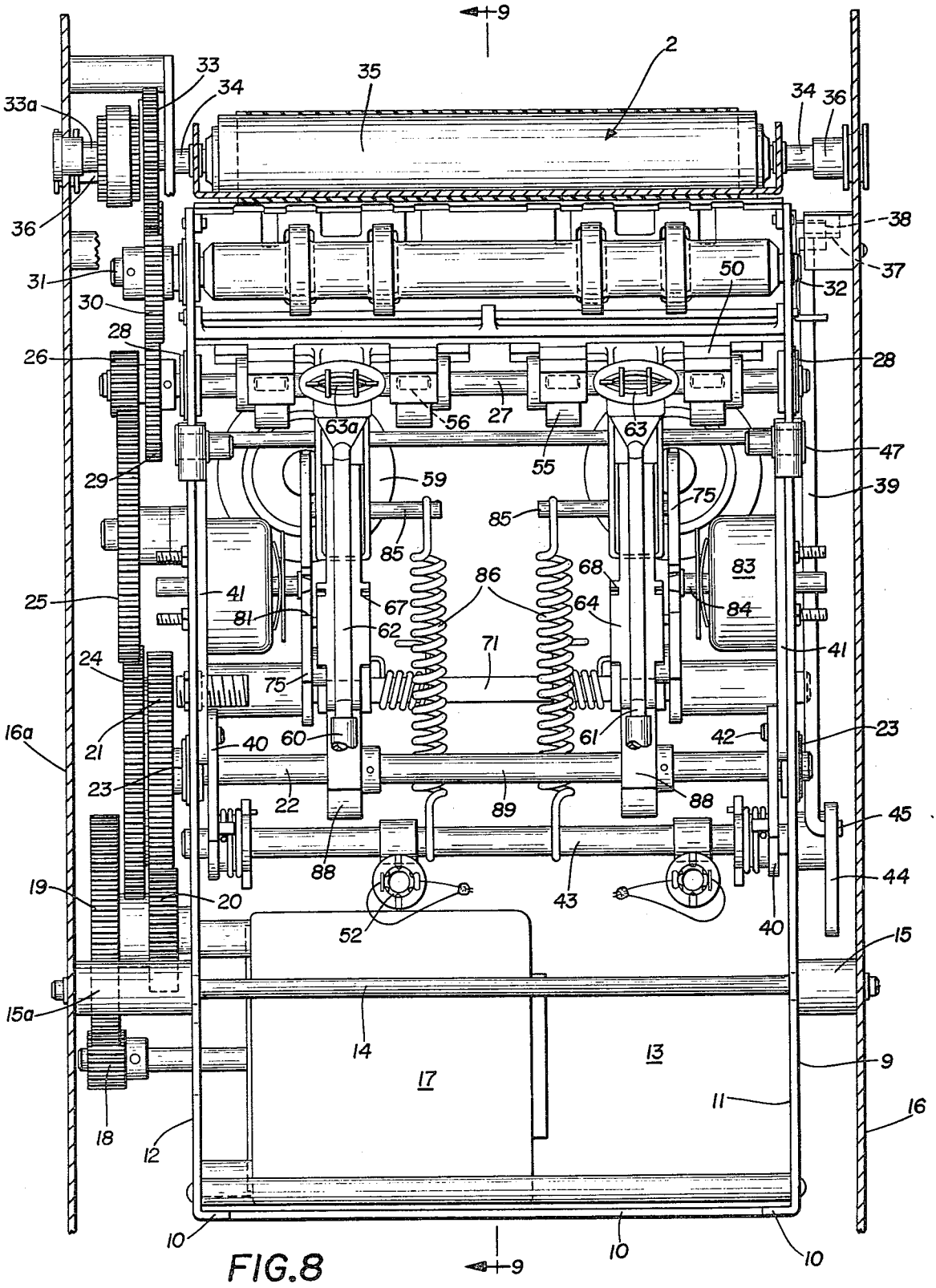
FIG. 8 is an enlarged sectional view taken on the line 8—8, FIG. 1 illustrating, mostly in full lines, various components of the picker mechanism and the mounting of the picker housing and related components within the ATM unit.

The picker housing 9 when closed and latched has a pair of levers 40 and 41 adjacent each sidewall 11 and 12 inside the housing pivotally connected at 42. Levers 40 are fixed to and rotate with shaft 43 which is journaled at its ends in the housing sidewalls 11 and 12 (FIG. 8). The end of shaft 43 outside the housing sidewall 11 has a handle 44 fixed thereto to which the lower end of actuator 39 is pivotally connected at 45. Handle 44 actuates both pairs of levers 40 and 41.

The full line position of handle 44 (FIG. 5) is the normal latched position thereof, wherein levers 40 and 41 connected with the handle 44 are shown in dotted lines. The upper end of lever 41 has a pin 47 movable in a cam slot 48 formed in the housing sidewall 11 (FIG. 5) at the lower end of said slot 48. The pin 47 (FIG. 10) is engaged with the door 7 of note container 4 at 49 and has moved the door downward to open position as shown in FIG. 11 thus pulling the container to the right into the housing 9 at the position also shown in FIG. 11.

The dot-dash position of the handle 44 in FIG. 5 shows the pin 47 at the top of cam slot 48 in a position moving container 3 to the left of the position shown in FIG. 11 where the pin 48 can be withdrawn from engagement at 49 with the sliding door 7 when the handle 44 is moved further downward to the position shown in dot-dot-dash lines in FIG. 5 to unlatch the housing 9, as shown in FIG. 6.

In the description of the operation of the handle 44 and levers 40 and 41 with respect to FIG. 5, the interengagement or interconnection thereof with a note container involves note container 3. As shown in FIG. 8, the similar levers 40 and 41 are connected operatively with note container 4.

When handle 44 is in normal position, the pairs of levers 40 and 41 have pulled the note containers 3 and 4 to the position shown in FIG. 11 and each container door 7 is open, uncovering the container access opening 5. When in such position, guides 50 engage end portions of the stack of notes 51 contained in the containers. These guides normally are separated from the note containers, such as the note container 4 shown in FIG. 9, where the container door 7 is closed and its key 52 has been actuated to lock the container lock 53 in locked position and has been withdrawn from the lock to permit the housing 9 to be unlatched and opened for removing the note container 4 in sealed, tamper-indicating condition.

Figure 22:
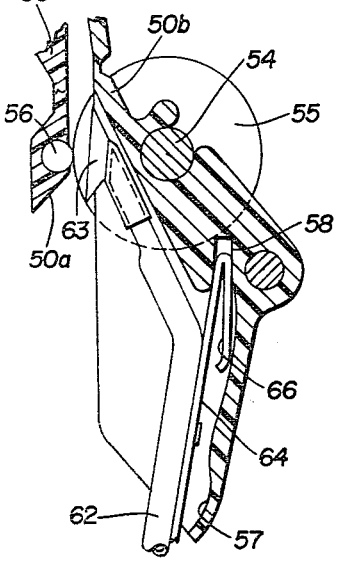
FIG. 22 is an enlarged view of certain portions of FIG. 16.

Referring to FIG. 22, the guides 50 have two fingers, **50*a* and 50*b*, and one of the fingers 50*b* engages a transport mechanism shaft 54 having a large diameter conveyor drive roll 55 engaged with a needle roll 56 carried by finger 50*a* (FIGS. 8 and 22). The guide finger 50*b* is elongated and formed with a groove 57 and a recess 58 (FIG. 22**) for purposes to be described.

Picker mechanism components are provided for each note container 3 and 4 and only one set of components for one note container is described below since the set of components for the one container is duplicated and operated by the same drive mechanism consecutively when notes are being dispensed from both containers.

Picker mechanism components for a note container include (FIGS. 8 and 9), a bellows 59 mounted on the housing wall 13. The interior of the bellows is connected by a tube 60, preferably flexible, connected at its other end with an end 61 of a preferably metal picker tube 62 which has a picker head or cup 63 (FIG. 14). The tube 62 has a flat spring-metal strip 64 secured thereto with spring-metal ends 65 and 66 projecting from the tube 62, respectively, at the bottom and top ends of the central flat portion of its strip 64.

The flat portion of the strip 64 intermediate its spring ends (FIG. 8) has notches 67 engaged by spaced fingers 68 (FIG. 12) at the ends of a strip plate 69 which is pivotally mounted at its other end at 70 on bellows plate shaft 71. A spring 72 connects strip plate 69 with the flat central portion of strip 64. One end of spring 72 is connected to an angular projection 73 (FIG. 12) on strip plate 69 and the other end of the spring 72 is attached to the strip 64 intermediate the ends of the central portion thereof at 74 as shown in FIG. 9. The spring 72 urges engagement of the fingers 68 with the notches 67 in strip 64 (FIG. 8) and urges the picker tube 62 to pivot counterclockwise (FIG. 9) on the fingered end of strip plate 69 which serves as a mounting member for the picker tube member 62. In the normal at-rest or nonpicking position of the picker mechanism components, the upper folded spring end 66 of strip 64 is held engaged in recess 58 of guide finger **50*b* (FIG. 22**).

A bellows plate 75, somewhat triangular in shape, also is pivotally mounted on the shaft 71, and one corner 76 of the bellows plate 75 is pivotally connected at 77 with a connector member 78 projecting from the bellows 59.

Bellows plate 75 has a cam follower pin 79 projecting laterally therefrom at a triangular location remote from the pivotal connections 70 and 77 of the plate 75. One edge portion of the plate 75 is flattened at 80 and formed with a recess 81, and the plate 75 has a pin 82 projecting therefrom adjacent the recess 81.

Figure 15:
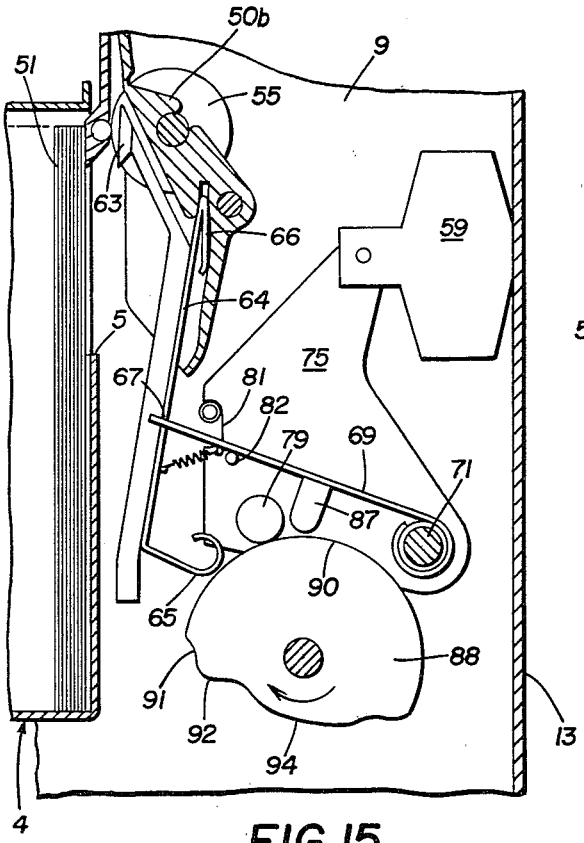

A solenoid 83 is mounted on housing sidewall 11 (FIG. 8) having an armature 84 projecting therefrom with its end engaging bellows plate recess 81 to hold the bellows plate 75 in inoperative position shown in FIGS. 9 and 15 when the picker mechanism is not actuated to pick notes 51 from a note container. The bellows plate 75 has a control pin 85 projecting therefrom at its corner portion 76 adjacent the pivotal connection 77 to which one end of a heavy control spring 86 is connected. The other end of the spring 86 is engaged with shaft 43.

Spring 86 exerts a strong pull on the bellows plate 75 to rotate the latter counterclockwise (FIG. 9) on bellows plate shaft 71 but the plate 75 is restrained by the solenoid armature 84 engagement in the bellows plate recess 81, excepting when the picker mechanism is actuated to pick a note from a note container.

The strip plate 69 also has a cam follower portion 87 projecting downward from a central portion thereof between its ends.

Picker control cam 88 is fixed to cam shaft 89 rotated clockwise, viewing FIGS. 9 and 15 through 20, when motor 17 is energized or enabled by motor drive gear 21 when the dispenser unit 1 is operated to dispense notes. Cam 88 is located adjacent the bellows plate pivot shaft 71 and has a circular segment surface 90 one end of which is formed with a recess 91 followed by a lobe 92 in turn followed by a further radially sloping portion 93 merging into a smaller diameter sector 94 connected by a curved portion 95 with a lobe 96 connected to the other end of circular segment 90. Thus, cam 88 has an endless peripheral actuating surface which is engaged by each of cam followers 65, 79 and 87.

An operation of picking a note 51 from a note container access opening proceeds as described below, in accordance with the sequential stages illustrated in FIGS. 15 through 21, the path of movement of the picker cup 63 being shown in FIG. 13.

Figure 16:
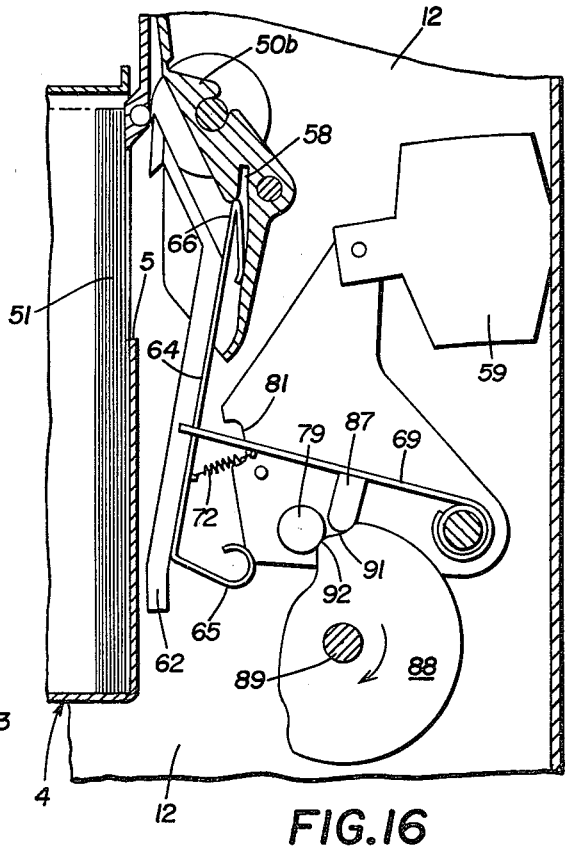
Figure 17:
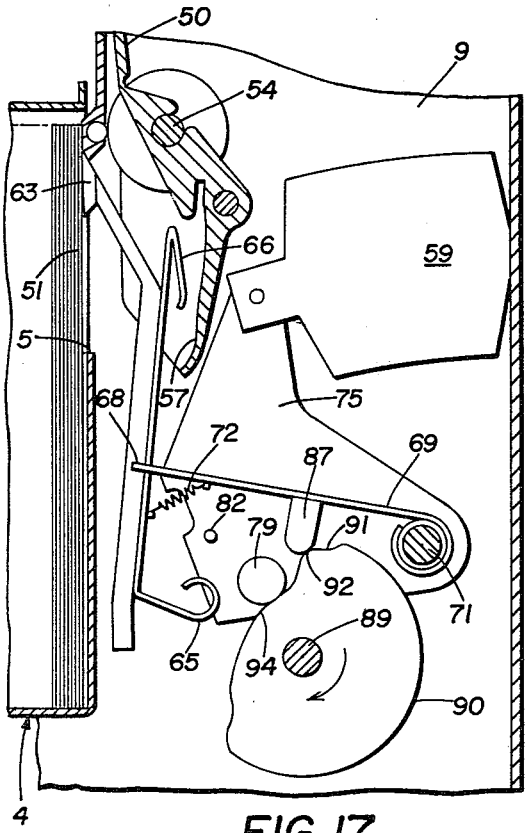

In the diagram (FIG. 13), the picker cup 63 is normally at rest at position A, where it is located adjacent the exposed end note of the note supply stack 51. When a picking operation is energized, the cup 63 moves from position A to position B generally downward parallel to and spaced from the plane of the exposed note 51 in a note container (FIG. 11). Cup 63 then moves toward the note generally normal to the plane of the note exposed at access opening 5 from the point B to the point C. The position of the cup at point A is shown in FIG. 15 and its movement to point B is shown in FIG. 16 while movement to point C is shown in FIG. 17, where the cup 63 engages an upper end portion of the exposed note.

Figure 18:
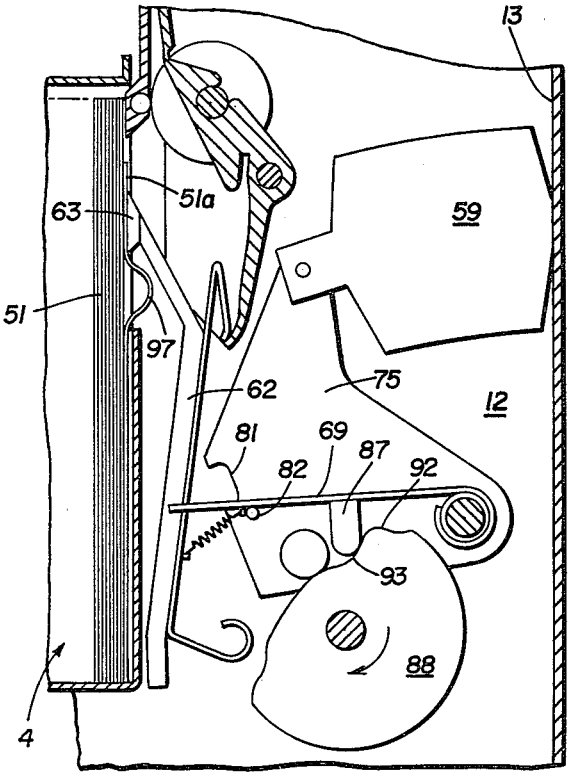

Cup movement then proceeds in a downward direction from point C to point D parallel with the planes of the notes in the note container, such movement to point D being shown in FIG. 18 with the cup 63 still pressing against the notes and peeling or dragging the engaged note end downward from beneath the guide finger 50*a* and forming a loop 97 in the note 50.

The cup 63 then moves from point D to point E with a combined motion laterally away from the stack of notes in a direction normal thereto combined with the start of motion upwardly in direction opposite that of its movement from point C to point D, the position of the cup 63 at point E being shown in FIG. 19.

The cup 63 continues to move upward from point E to point F, the location of the cup 63 at point F being shown in FIG. 20 having moved the upper end portion of the note being picked to enter the bite of the driven conveyor roll 55 against needle roll 56.

Cup 63 then completes its cycle of movement from point F to point G which coincides with point A. Meanwhile the bill is conveyed by rolls 55-56 and others (not shown) from the note container as shown in FIG. 21 which illustrates the position of picker tube 62 at point G-A, the cup 63 having retracted from the note 51 and the spring end 66 having entered the recess 58 in guide finger 50*b* in its normal at-rest position or ready to start another picking cycle or movement.

Thus, during the cycle of movement of the picker cup 63, the cup has moved toward and away from one end portion of the notes in a stack of notes, as well as moving longitudinally in each direction with respect to the length of any note in the stack, said longitudinal movement being generally in in directions parallel with the surface of the end note, or in other words at right angles to or normal to the direction of cup movement toward and away from the note.

The operation of the picker mechanism to move the picker cup 63 through the cycle of operation just described is shown diagrammatically in FIGS. 15 through 21 and is as follows:

FIG. 15-A position—In the A position shown in FIG. 15, the important components of the picker mechanism are shown at rest ready to be actuated to pick a note from a stack of notes 51. Cam follower 79 on bellows plate 75 is engaged with cam segment 90 but cam follower spring end 65 and cam follower 87 are spaced from cam segment 90. Pin 82 on bellows plate holds strip plate 69 in the at-rest position shown which holds the end 66 of spring strip 64 locked in raised position in recess 58 of guide finger 50*b*. In this at-rest position of the picker member 62–64, its suction cup 63 is held out of contact with the end note in the stack 51. Meanwhile, solenoid armature 84, which is engaged in bellows plate recess 81 holds the bellows plate in the position shown and the cam 88, if driven at this time, can rotate without actuating other components of the picker mechanism.

When the dispenser unit 1 calls for a note or notes to be dispensed, the solenoid 83 is energized retracting the armature 84 from the recess 81 permitting the cam follower 79, pressed against the cam 88 by the spring 86 to ride along the periphery of the cam 88 as it rotates from the position of FIG. 15 to that of FIG. 16. During such rotation, the bellows plate is pulled by spring 86 and the bellows connector 78 expands the bellows 59 starting to establish a condition of suction therein. Meanwhile, cam follower 87, riding on cam 88, holds strip plate 69 up in the position shown in FIG. 16 so that the spring end 66 of strip 64 is just about to be released from recess 58 in guide finger 50*b* as shown in FIG. 16.

FIG. 16-B position—At this stage in the cycle, the solenoid armature 84 having been released and the bellows plate thus having been permitted to follow the cam 88, the components are permitted to assume the positions shown in FIG. 16.

FIG. 17-C position—During continued rotation of cam 88, cam follower 79 moves toward the cam shaft 89 accompanied by movement of the bellows plate 75 to the position shown in FIG. 17 fully expanding the bellows 59 which completes the condition of suction in the bellows. Follower 87, moving in cam recess 91, permits the strip plate 69 to move downward releasing spring end 66 from being held in recess 58 and the cup 63 is pulled by spring 72 to engage the exposed note 51. The developed vacuum in the bellows 59 establishes a vacuum condition in the opening 63*a* of picker cup 63 enabling the cup to suck the engaged surface of the note 51, which also is engaged by the pressure exerted by the cup 63 against the note surface, which pressure is maintained by the action of the spring 72. Thus, the picker head suction cup 63 is pressure-and-suction-engaged with the end note in stack 51.

The combined suction and pressure engagement of the cup 63 is an important aspect of the invention. Prior art pickers depending upon suction alone are known and normally work well when only new notes are being picked. However, such vacuum pickers do not work well on old notes which may be crumpled, folded, etc., which prevents a suction connection between such old notes and a picker cup.

Prior art pickers depending upon pressure alone are known and they work well with old notes but they do not work well with new notes which normally have a sandpapery texture which causes new notes to stick together.

Thus, combined suction and pressure operation of the new picker mechanism enables new or old notes or a combination thereof, which may be random, to be picked from a stack of notes in a container and avoids the problems that have existed with either the prior art suction picker or the prior art pressure picker.

FIG. 18-D position—As the cam 88 rotates from the position of FIG. 17 to that of FIG. 18, the cup 68 moves rapidly downward as the follower 87 moves down along radially sloping cam portion 93 until pin 82 on bellows plate 75 stops movement of strip plate 69 as shown in FIG. 18. The downward movement of cup 63 peels the upper end 51*a* of the engaged note downward forming the loop 97. As this loop or buckle 97 is formed in the note being peeled during the picking operation, the buckle moves through the brushes 8 (FIG. 10) projecting into the access opening 5 at either side thereof; and these brushes prevent the loop or buckle from springing back and keep the peeled note end 51*a* separated from notes in the stack. A further function of the brushes 8 is to assist in separating adjacent notes if, particularly with new notes, a second note tends to stick to the exposed note being picked.

FIG. 19-E position—As the cam continues to rotate from the position of FIG. 18 to that of FIG. 19, the cam lobe 96 engages the lower spring end 65 of the flat strip 64 which tilts the strip 64 and picker tube 62 mounted thereon pivotally about the forked end of strip plate 69 moving the cup 63 laterally away from the stack of notes 51, thus pulling the upper end 51*a* of the attached note laterally out through the access opening 5. Meanwhile, the pin 82 on the bellows plate 75 engages strip plate 69 holding it up and stairs to raise the end 51*a* of the note upward from the loop 97.

FIG. 20-F position—Continued rotation of the cam pushes up on both of the cam follower spring end 65 and the cam follower 79, the latter of which pivots the bellows plate 75 clockwise starting to collapse the bellows 59. Also the pin 82 on the bellows plate raises the strip plate 69, all of which raises the cup 63 upward carrying with it the upper end 51*a* of the note being picked and entering the same into the bite of the conveyor rolls 55 and 56, roll 55 being driven. Meanwhile, the initiation of collapse or contraction of the bellows 59 reduces the vacuum. Also, spring end 66 of flat strip 64 moves upward in guide fingers groove 57 toward entry into recess 58.

FIG. 21-G position—As cam 88 continues to rotate, the bellows plate 75 movement completely collapses bellows 59 eliminating vacuum and pin 82 raises strip plate 69 to enter spring end 66 into recess 58 in guide finger 50*b*. The bellows plate 75 now is in a position for the armature 84 of the solenoid 83, which has been de-energized, to move its end into the recess 81 of the bellows plate, holding the latter in the at-rest position unless more notes are to be dispensed in which case the circle is repeated.

The foregoing description indicates that components involved in the picking procedure that are movable are all pivoted on the bellows plate shaft 71 and that component movement of all components is driven by the control cam 88. For example, the bellows plate 75 oscillates on the pivot shaft 71 during a cycle of operation.

A further advantage of the combined suction and pressure operation of the picker cup 63 involves the situation presented if suction from the bellows 59, which is self-generated in operation of the components, breaks down for some unexpected or accidental reason. Under such conditions, the pressure of the cup 63 frictionally against a note moves the end of the note down and forms the loop 97 and as the cup 63 retracts to the right in moving from the FIG. 18 position to that of FIG. 19, the end of the note springs upward from the loop and toward the conveyor rolls and the cup 63, which has some pressure, pushes up. The end of the note will be engaged by the conveyor rolls 55 and 56 because it has nowhere else to go.

Accordingly, the new picker mechanism construction and operation satisfy the stated objectives; avoid problems that have arisen in the past with prior art picker mechanism; enable notes to be withdrawn one at a time from sealed, tamper-indicating containers having access openings rectangular in shape but smaller in at least one direction than the dimensions of the note being picked; and thereby satisfy needs existing in the field of automatic banking equipment.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set in the appended claims.

We claim:

1. Picker mechanism for an ATM note dispenser provided with a supply of notes in a sealed, tamper-indicating note container having an access opening exposing, when uncovered, the end note of the note supply stack of notes in the container, in which the access opening is rectangular in shape and has dimensions one of which is less than the length of the notes in the stack to be picked one at a time through the access opening; including a picker housing; a through picker member having an open cup; means mounting the picker member in the housing with the open cup adjacent said access opening; a bellows mounted in the housing; tube means connecting the bellows and picker member; a bellows plate pivotally mounted on a bellows plate pivot shaft in the housing and connected with the bellows; means movably mounting the picker member on the bellows plate pivot shaft; a cam rotatably mounted in the housing having an endless peripheral actuating surface engageable with each of bellows plate, picker member, and picker member mounting means cam followers; and drive means moving the cam through a picking operation cycle to move the cup multi-directionally into and out of the access opening and also back and forth across the access opening in directions parallel with the length of notes in the stack; said bellows being actuated by and during cam movement to supply suction to the cup; and the picker member mounting means pressing the picker member open cup against an end portion of the end note of the supply stack exposed through said access opening, to suction-and-pressure-engage the cup to said note end portion to peel and extract said end note lengthwise from the stack.

2. The construction defined in claim 1 in which the cam followers include a pin on the bellows plate engaged by the cam to pivot the bellows plate on its pivot shaft, a projection on the picker member mounting means, and a spring finger mounted on the picker member.

3. The construction defined in claim 2 in which a pin is mounted on the bellows plate engageable at intervals with the picker member mounting means during cam movement to control movement of the picker member mounting means.

4. The construction defined in claim 3 in which solenoid means is mounted in the housing having an armature normally engaged with the bellows plate disabling movement of the bellows plate and picker member during cam movement; and in which the armature is released from the bellows plate to enable a note picking operation when the ATM calls for notes to be dispensed.

5. Picker mechanism for an ATM note dispenser in which a supply stack of notes is held in the dispenser with the end note in the note supply stack exposed, and in which the notes are picked one at a time from the note supply stack; including, (a) a picker housing;

(b) bellows means mounted in the housing;

(c) a bellows plate pivot shaft mounted in the housing;

(d) a bellows plate mounted for oscillating movement on said pivot shaft in the housing and pivotally connected with the bellows means for expanding and contracting the bellows means during such oscillating movement;

(e) picker means in the housing;

(f) the picker means including a picker member having note engageable picker head means provided with a suction cup located adjacent the exposed end note of a note supply stack, and also including a mounting member engaged with the picker member and pivotally mounted on the bellows plate pivot shaft;

(g) a cam rotatably mounted in the housing adjacent the bellows plate pivot shaft having an endless peripheral actuating surface;

(h) cam follower means on the bellows plate, on the picker mounting member, and on the picker member each engageable with said endless cam peripheral actuating surface;

(i) drive means, when enabled, rotating the cam from a position at rest through a picking operation cycle;

(j) means connecting the bellows means and picker head means to supply suction to the picker head suction cup as the bellows means is actuated during bellows plate oscillating movement imparted by the cam during a cam picking operation cycle;

(k) holding means for positioning the suction cup on the picker member out of contact with the end note when the cam is at rest;

(l) the picker member being biased to pressure-engage its suction cup with an end note when released from said holding means; and (m) the cam, cam follower means, picker means and bellows plate during a cam picking operation cycle releasing the picker member from said holding means to enable the picker head means to move toward and to pressure-and-suction-engage said end note and with the end note engaged to move back and forth in directions parallel with the length of the end note and also away from the stack;

(n) whereby the picker head means pressure-and-suction-engaged with said end note peels and extracts said end note from the stack during a cam picker operation cycle.

* * * * *

UNITED STATES PATENT AND TRADEMARK OFFICE

CERTIFICATE OF CORRECTION

PATENT NO. : 4,355,797

DATED : October 26, 1982

INVENTOR(S) : Harry T. Graef et al

It is certified that error appears in the above-identified patent and that said Letters Patent are hereby corrected as shown below:

Column 1, line 39, change "transparent" to -transport-

Column 2, line 40, change "solve" to -solves-

Column 9, line 27, change "stairs" to -starts-

Column 10, line 38, change "through" to -tubular-

Signed and Sealed this

*Twenty-second* Day of *February 1983*

[SEAL]

*Attest:*

GERALD J. MOSSINGHOFF

*Attesting Officer*

*Commissioner of Patents and Trademarks*